US007959181B2

(12) United States Patent
Weissenberger

(10) Patent No.: US 7,959,181 B2
(45) Date of Patent: Jun. 14, 2011

(54) SNOWBOARD FIXING DEVICE

(76) Inventor: Dirk Weissenberger, Klettgau (DE)

( * ) Notice: Subject to any disclaimer, the term of this patent is extended or adjusted under 35 U.S.C. 154(b) by 200 days.

(21) Appl. No.: 12/089,397

(22) PCT Filed: Oct. 6, 2006

(86) PCT No.: PCT/DE2006/001749
§ 371 (c)(1),
(2), (4) Date: Sep. 10, 2008

(87) PCT Pub. No.: WO2007/041991
PCT Pub. Date: Apr. 19, 2007

(65) Prior Publication Data

US 2009/0212513 A1 Aug. 27, 2009

(30) Foreign Application Priority Data

Oct. 7, 2005 (DE) ..... 20 2005 015 736 U

(51) Int. Cl.
*A63C 9/00* (2006.01)

(52) U.S. Cl. ..... 280/626; 280/14.24

(58) Field of Classification Search ..... 280/14.21, 280/14.24, 626–632, 606, 607, 617, 11.3, 280/11.14
See application file for complete search history.

(56) References Cited

U.S. PATENT DOCUMENTS

| | | | | |
|---|---|---|---|---|
| 5,813,689 | A * | 9/1998 | Mansure | 280/607 |
| 5,855,390 | A * | 1/1999 | Hassell | 280/607 |
| 6,065,770 | A * | 5/2000 | Hansen et al. | 280/617 |
| 6,168,173 | B1 | 1/2001 | Reuss et al. | |
| 6,898,874 | B2 * | 5/2005 | Emerson et al. | 36/122 |
| 2001/0017453 | A1 | 8/2001 | Reuss et al. | |
| 2003/0126764 | A1 | 7/2003 | Emerson et al. | |

FOREIGN PATENT DOCUMENTS

| | | | |
|---|---|---|---|
| AT | 5260 | U1 | 5/2002 |
| DE | 3811096 | A1 | 10/1989 |
| FR | 2673546 | A1 | 9/1992 |

* cited by examiner

*Primary Examiner* — J. Allen Shriver, II
*Assistant Examiner* — Erez Gurari
(74) *Attorney, Agent, or Firm* — Gudrun E. Huckett

(57) ABSTRACT

A snowboard binding has a front fixation device and a rear fixation device. The front fixation device and the rear fixation device secure a snowboard boot in a way that the snowboard boot is able to perform a free lateral roll movement about an axis extending in a longitudinal direction of the snowboard binding. The front and rear fixation devices have pivot points located in an area of a toe of the snowboard boot and in an area of a heel of the snowboard boot, respectively.

9 Claims, 2 Drawing Sheets

SNOWBOARD FIXING DEVICE

BACKGROUND OF THE INVENTION

The invention concerns a snowboard binding with a front fixation device as well as a rear fixation device for a snowboard boot.

Snowboard bindings are known in many embodiments. One embodiment provides that the snowboard binding has a front fixation device as well as a rear fixation device. By means of these two fixation devices, the tip as well as the heel of the snowboard boot is secured on the snowboard.

A disadvantage of this known snowboard binding resides in that the snowboard boot is more or less rigidly secured in the binding. This causes the riding comfort to diminish.

Based on this, it is an object of the invention to provide a snowboard binding of the aforementioned kind with improved riding comfort.

SUMMARY OF THE INVENTION

The technical solution is characterized in that the snowboard boot is secured between the front fixation device and the rear fixation device in such a way that it can perform a free lateral roll movement about an axis extending in the longitudinal direction of the snowboard binding.

In this way, a snowboard binding is provided that, in comparison to the known snowboard bindings, is characterized by improved riding comfort. The basic idea of the snowboard binding resides in that the snowboard boot is no longer rigidly secured between the front fixation device and the rear fixation device but, instead, according to the invention the snowboard boot can carry out a lateral roll movement. This means that the snowboard boot is suspended like a swing. In this way, the lateral roll movement can be carried out freely. The free execution of roll movement means that the tilting position of the snowboard boot relative to the snowboard binding can be adjusted freely depending on the position of the snowboard rider on the snowboard. It is however conceivable that by means of a corresponding spring device at increasing tilting angle an increasing restoring force will be generated.

Preferably, the two pivot points are located in the area of the toe of the snowboard boot and in the area of the heel of the snowboard boot. This means more or less that the longitudinal center axis of the foot substantially defines the roll movement axis of the snowboard boot in the snowboard binding.

The basic idea for technical realization resides in a rotary support. In this connection, the rotary support can be embodied immediately between the snowboard boot and the two fixation devices. However, an indirect configuration of the rotary support is conceivable in that a separate rotary device is provided that receives the snowboard boot.

A concrete technical realization of the aforementioned rotary support is proposed in that the rotary support is formed by a rotary projection, in particular by a rotary pin, that engages a matching receptacle. In this connection, the rotary projection can be arranged either on the snowboard boot (for a receiving housing for the snowboard boot) or, alternatively, on the fixation device. The matching receptacle is then formed at the other part. Instead of being in the form of a rotary pin, the rotary projection can also be in the form of a cylinder section or a half moon-shaped part that is open in the downward direction and on which the receptacle is supported. Other shapes are easily conceivable. It is decisive that a lateral roll movement is enabled.

An immediate rotary support is proposed wherein the rotary projection is formed directly on the snowboard boot.

This means that the snowboard boot, at the toe as well as the heel, has a rotary projection wherein the axes of the two rotary projections are aligned with one another.

An alternative is proposed in by means of an indirect rotary support in that the rotary projection is formed on an additional housing that receives the snowboard boot. However, in this connection a reverse arrangement is conceivable also in that the rotary projection is arranged on the fixation device while the receptacle is provided on the housing.

According to a preferred embodiment the two fixation devices are shell-shaped. This shell-shaped embodiment has the advantage that the heel as well as the toe of the snowboard boot are secured optimally and that moreover in both shells a receptacle for the rotary support can be formed.

Finally, another embodiment proposes that the two fixation devices with respect to their distance are adjustable relative to one another. This has the advantage that the snowboard binding can be used universally for different snowboard boot sizes.

BRIEF DESCRIPTION OF THE DRAWINGS

One embodiment of the snowboard binding according to the invention will be explained to the following with the aid of the drawings. It is shown in.

DESCRIPTION OF PREFERRED EMBODIMENTS

Figure 1:
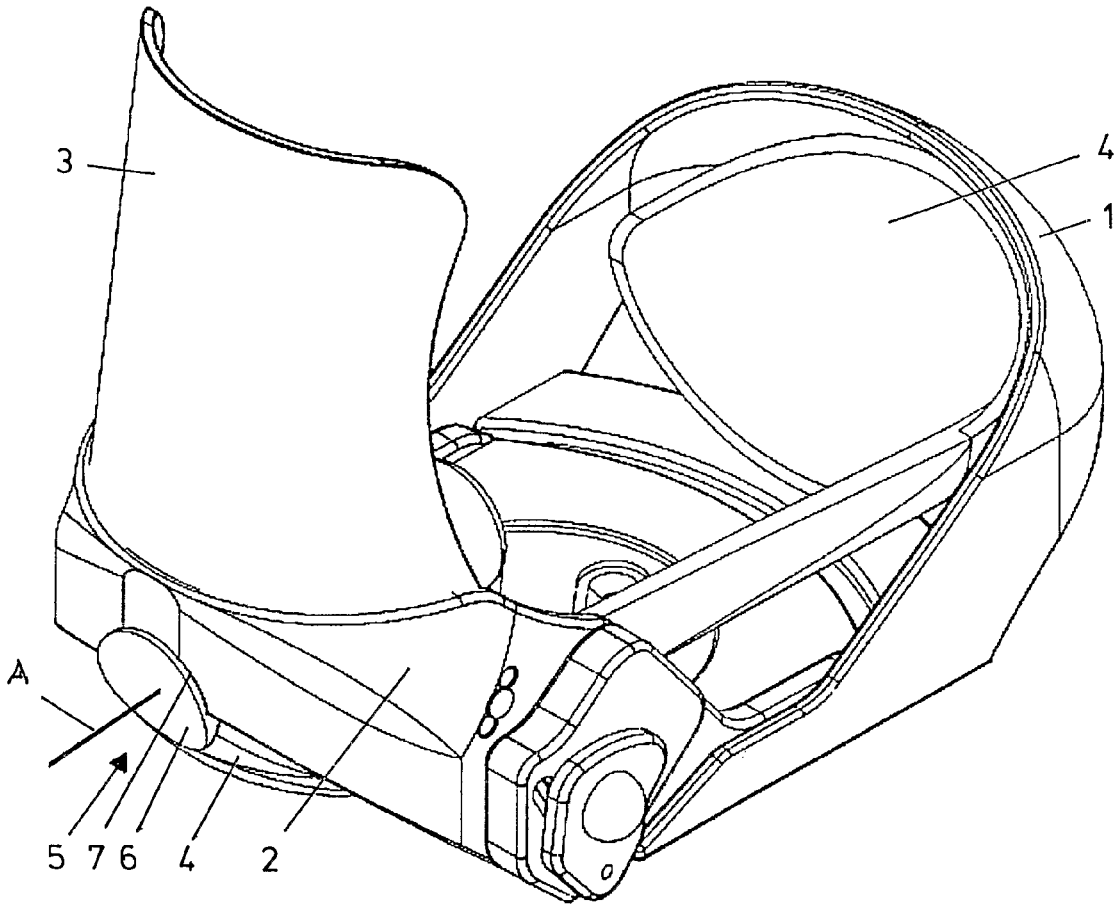
FIG. 1 a perspective view of the snowboard binding.

The snowboard binding has a shell-shaped front fixation device 1 as well as a rear fixation device 2 that is also shell-shaped and is provided with a heel support 3. A snowboard boot 4 is indicated only schematically in the drawing. It is secured between the front fixation device 1 and the rear fixation device 2.

The special feature of such a securing action of the snowboard boot 4 resides in a rotary support 5 in such a way that the snowboard boot 4 can be freely pivoted by a lateral roll movement about an axis A extending in a longitudinal direction of the snowboard binding. For providing the rotary support 5 the front end as well as the heel of the snowboard boot 4 have a cylindrical rotary pin 6 wherein the axes of these two rotary pins 6 are aligned with one another and coincide with the axis A of the rotary support 5. Corresponding to these two rotary pins 6 the front fixation device 1 as well as the rear fixation device 2 each have a receptacle 7 in which the two rotary pins 8 are rotatably supported about axis A.

The function is as follows.

Figure 2B:
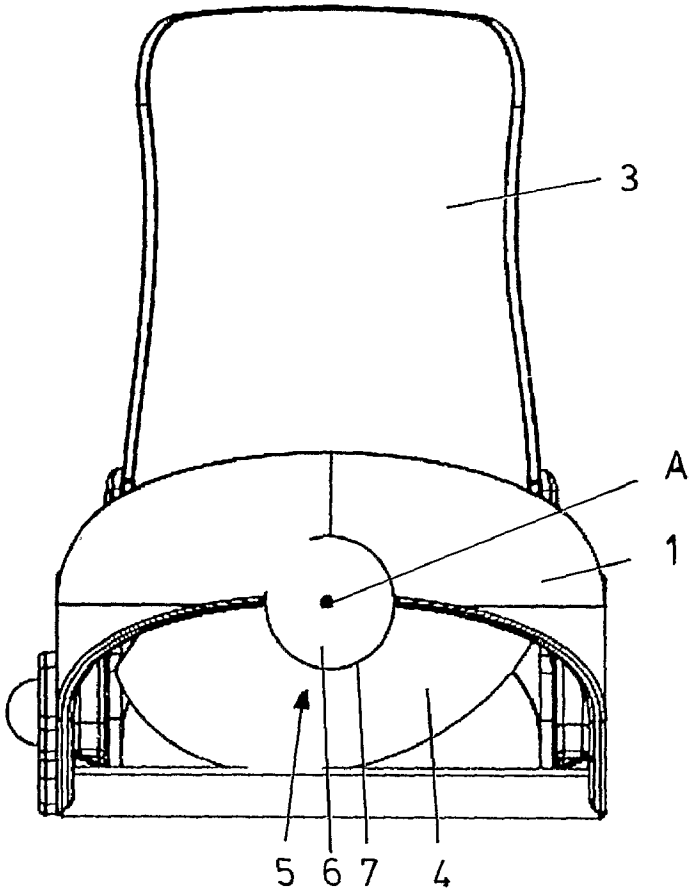
FIG. 2*b* a front view of the snowboard binding of FIG. 1 showing a roll movement in the other direction.
Figure 2A:
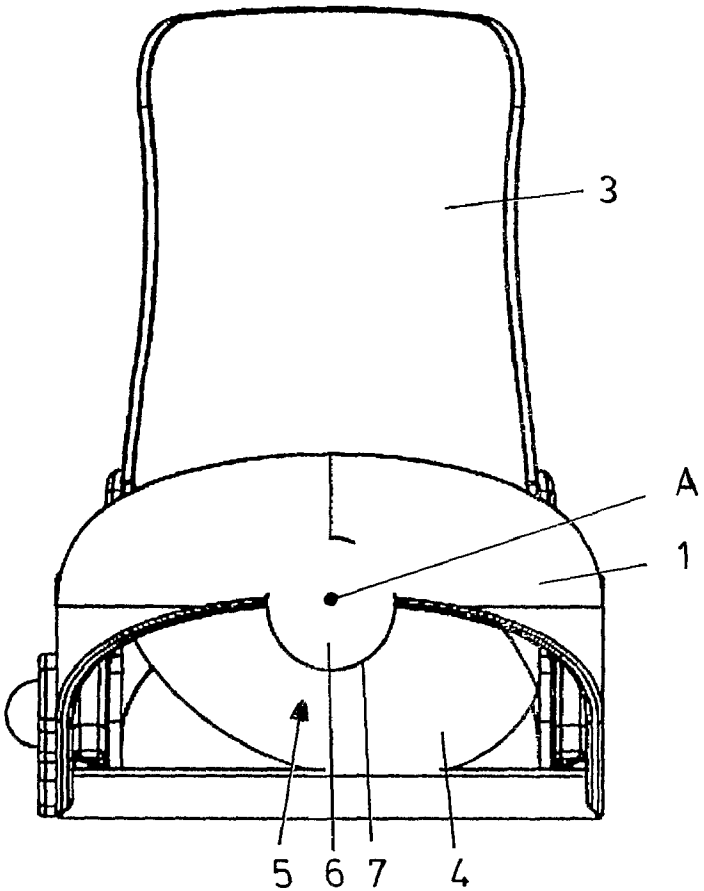
FIG. 2*a* a front view of the snowboard binding of FIG. 1 showing a roll movement in one direction.

As already mentioned, the two rotary pins 6 of the snowboard boot 4 define a rotary support 5 for rotating the snowboard boot 4 about the axis A. This means that, depending on the riding position and position of the snowboard rider on the snowboard, the snowboard boot 4 performs a tilting movement about the axis A, either in one or the other direction as indicated in FIGS. 2*a* and 2*b*.

LIST OF REFERENCE NUMERALS

1 front fixation device
2 rear fixation device
3 heel support
4 snowboard boot

5 rotary support
6 rotary pin
7 receptacle
A axis

What is claimed is:

1. Snowboard binding comprising:

a front fixation device and a rear fixation device;

wherein the front fixation device and the rear fixation device secure a snowboard boot in a way that the snowboard boot is enabled to perform a free lateral roll movement about an axis extending in a longitudinal direction of the snowboard binding;

wherein the front fixation device and the rear fixation device each comprise a pivot point and wherein the pivot points are located in an area of a toe of the snowboard boot and in an area of a heel of the snowboard boot;

wherein between the toe of the snowboard boot and the front fixation device and between the heel of the snowboard boot and the rear fixation device a rotary support is provided, respectively.

2. Snowboard binding according to claim 1, wherein said rotary supports are comprised of a rotary projection and a matching receptacle, respectively.

3. Snowboard binding according to claim 2, wherein said rotary supports are disposed between the snowboard boot and the front and rear fixation devices.

4. Snowboard binding according to claim 2, wherein said rotary supports are disposed between a housing, serving as a receptacle for the snowboard boot, and the front and rear fixation devices.

5. Snowboard binding according to claim 2, wherein the rotary projection is a rotary pin.

6. Snowboard binding according to claim 2, wherein the rotary projections are formed directly on the snowboard boot.

7. Snowboard binding according to claim 2, wherein the rotary projections are formed on a housing serving as a receptacle for the snowboard boot.

8. Snowboard binding according to claim 1, wherein the front and rear fixation devices each are shell-shaped.

9. Snowboard binding according to claim 1, wherein the front and rear fixation devices are adjustable with regard to a longitudinal distance relative to one another in a longitudinal direction of the snowboard binding.

* * * * *